US005950818A

United States Patent [19]

Paulsen

[11] Patent Number: 5,950,818

[45] Date of Patent: Sep. 14, 1999

[54] DISPOSABLE BAGS AND DISPENSER FOR FEMININE HYGIENE ITEMS

[76] Inventor: Irene Paulsen, 656 Magnolia Rd., Mobile, Ala. 36606

[21] Appl. No.: 09/104,022

[22] Filed: Jun. 24, 1998

[51] Int. Cl.[6] ..... B65D 81/24; B65D 85/672

[52] U.S. Cl. ..... 206/205; 206/409; 206/459.5; 206/581; 206/823

[58] Field of Search ..... 206/205, 581, 206/225, 389, 408, 409, 554, 459.5, 823, 438, 440; 383/37, 208–210; 242/159, 160.1, 160.3, 170

[56] References Cited

U.S. PATENT DOCUMENTS

| | | | |
|---|---|---|---|
| 3,228,737 | 1/1966 | Kipnis . | |
| 3,618,750 | 11/1971 | Relner . | |
| 4,008,933 | 2/1977 | Wanek . | |
| 4,280,643 | 7/1981 | Cordova et al. . | |
| 4,611,716 | 9/1986 | Sorlien . | |
| 4,722,462 | 2/1988 | Zinnbauer | 206/823 |
| 4,974,730 | 12/1990 | Deruysscher . | |
| 5,170,957 | 12/1992 | Carpenter | 206/409 |
| 5,242,057 | 9/1993 | Cook et al. | 206/581 |
| 5,261,531 | 11/1993 | Nieves | 206/205 |
| 5,484,082 | 1/1996 | Casper et al. | 206/408 |
| 5,579,916 | 12/1996 | Manko | 206/581 |
| 5,819,935 | 10/1998 | Lawson | 206/409 |

*Primary Examiner*—Paul T. Sewell
*Assistant Examiner*—Luan K. Bui
*Attorney, Agent, or Firm*—Joseph N. Breaux

[57] ABSTRACT

A dispenser which is mountable within a bathroom and which includes an interior deodorizing means and which contains a multiplicity of rolled disposable bags wherein the disposable bags include an antibacterial agent contained within their interior and wherein said disposable bags are serially numbered to indicate to the user when the dispenser may need to be refilled with a new roll of disposable bags and furthermore wherein said dispenser provides a hinged slotted top which provides a replacement means for replacing the rolled disposal scented bags. Furthermore the dispensing unit deodorizing means provides a means for placing a small amount of deodorant material on an exterior surface of said disposable bags preventing noxious odors when the bags are placed into a trash container.

3 Claims, 1 Drawing Sheet

DISPOSABLE BAGS AND DISPENSER FOR FEMININE HYGIENE ITEMS

TECHNICAL FIELD

The present invention relates to devices and methods for disposing feminine hygiene items and more particularly to devices and methods for disposal bags and dispenser for disposing feminine hygiene items wherein the dispenser includes a deodorizing means which deposits a thin coating of deodorant on an outer surface of the disposal bags while the disposal bags includes an antibacterial agent interior coating while a multiplicity of bags are contained on a dispensing roll and further wherein the bags are serially marked to designate the number of bags used and/or remaining in said dispenser and wherein said dispenser may be placed in any desired location of a ladies restroom.

BACKGROUND ART

Disposing of feminine hygiene items in a restroom has long been a problem since placement of these items in a normal plumbing system will cause plumbing problems and furthermore placement of such items in an open waste container often leads to undesirable rancid odors to emanate from said open trash dispenser. Numerous prior devices have been disclosed which attempt to overcome these problems as follows:

Manko U.S. Pat. No. 5,579,916 which discloses a feminine hygiene carrier kit which is extremely useful for transporting feminine hygiene products however it does not include a means as the present invention for disposing of feminine hygiene items which comprises multiple bags dispensed from a dispenser which dispenser also includes a deodorizing means, while the bags include antibacterial agents which are also serially numbered to indicate the number of bags remaining in said dispenser for replacement purposes.

Jonese U.S. Pat. No. 5,443,161 discloses a disposable baby change kit. Although this device is also extremely useful it does not include a dispensing device which is mountable in a ladies restroom and which dispensing device indicates the number of disposable bags remaining for use.

Nieves U.S. Pat. No. 5,261,531 discloses a feminine hygiene package which is also extremely useful for its disclosed purposes however it also does not include a dispensing means which is mountable in a ladies restroom and also which is capable of dispensing numerous disposable bags which are serially indicated for quick reference to determine whether or not new bags are needed and which also include a deodorizing means on the exterior of said bags.

Cook, et al U.S. Pat. No. 5,242,057 discloses a convenience kit for dispensing different personal hygiene components. This device is also extremely useful for its disclosed purposes however like the previously mentioned devices it does not provide the dispensing means as the present invention.

Deruysscher U.S. Pat. No. 4,974,730 discloses a clean up kit for cleaning the genital areas following sexual intercourse. This device is also extremely useful for its disclosed purposes however it does not provide a means of containing hygiene items within a disposal bag which bag contains antibacterial agents and also which bags are dispensed through a dispensing means as described below.

Stephens U.S. Pat. No. 4,964,526 discloses a case for feminine hygiene products. The Stephens device like the previously mentioned devices does not include a dispensing means for numerous bags which bags include antibacterial agents and also which dispensing device includes a deodorant dispensing means.

The following patents also disclose different means of disposing hygiene products and other items and also for dispensing and storing bathroom accessories and/or items including Adams U.S. Pat. No. 4,739,809, Sorlien U.S. Pat. No. 4,611,716, Cordova, et al U.S. Pat. No. 4,280,643, Wanek U.S. Pat. No. 4,008,933, Reiner U.S. Pat. No. 3,618,750 and Kipnis U.S. Pat. No. 3,228,737. As will be shown below in the detailed description the present invention overcomes numerous problems not addressed or solved by the prior art devices including providing an efficient, convenient dispensing device which dispenses numerous disposal bags in a roll dispensing unit wherein each bag includes a scented exterior provided by a scenting material contained within an interior of the dispensing device and also said disposable bags include an antibacterial agent interior coating, said bags further comprising a serial numbering sequence thereby indicating to a user the number of bags remaining in said dispenser while the dispensing device can also be installed in a bathroom in a location of choice.

GENERAL SUMMARY DISCUSSION OF INVENTION

It is thus an object of the invention to provide Disposable Bags and Dispenser for Feminine Hygiene products that comprises a dispensing container mountable at a desired location within a bathroom, a multiplicity of disposable bags rolled and stored within an interior of said dispensing unit, a means for deodorizing an exterior surface of said rolled stored disposal bags, an antibacterial agents contained within an interior of said rolled disposal bags and a means for indicating the number of disposal bags remaining within said dispenser whereby alerting a user to replace the disposal bags when necessary.

It is a further object of the intention to provide disposal bags and dispenser for feminine hygiene items that may be mountable in numerous locations within a ladies restroom.

It is a still further object of the invention to provide disposal bags and dispensers for feminine hygiene products which provides a means for disposing feminine hygiene products within an open trash container which means prevents rancid odors from emanating from said open trash container, and further wherein said means allows for an alternative to disposing of said feminine hygiene items within the plumbing system of a users plumbing system.

Accordingly disposable bags and dispenser for feminine hygiene items is provided which includes a dispensing housing mountable on a desired location within a ladies restroom wherein said dispenser includes an interior which receives a multiplicity of rolled disposable bags wherein a deodorizing agent is also contained within said dispenser interior and wherein said multiplicity of bags are continuous on said roll and separated by perforations dividing each bag, further wherein each bag contains an antibacterial chemical agent and furthermore the opening of each bag is sealed by tongue and groove bag flap sealing means, further wherein the multiplicity of bags are serially numbered providing a means for a user to determine the number of bags remaining within said dispenser.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

As will become evident through the description herein the feminine hygiene item disposable bags and the dispenser would be mounted in a convenient location in a restroom such as the inside of a cabinet door or in any other convenient location in a woman's bathroom. When the need arises for a woman to dispose of a feminine hygiene product, she would remove one of the disposable bags from the dispenser by tearing the bag along perforations from the continuous rolled bags from the dispenser and then separate the tongue and groove top flap sealing mechanism on the bag and then place the item to be disposed in the bag and then reseal the tongue and groove top flap sealing means. Finally the sealed bag would then be disposed of in a nearby trash container. The number of bags remaining in the dispenser can be quickly ascertained by the user since the bags on a given roll are serially numbered indicating to the user the number of bags remaining within the dispenser and alerting the user to a low number of bags remaining inside the dispenser. In order to replace the bags the user would open the dispenser by its hinged top cover flap and replace the empty spindle with a fresh roll of disposable bags, while the dispenser is open the user may also visually inspect the dispenser interior deodorant dispenser for fullness. The user may at this point also replace an interior deodorant dispenser which provides scent agent to an interior of the dispenser and an exterior surface of the disposal bags.

Figure 1:
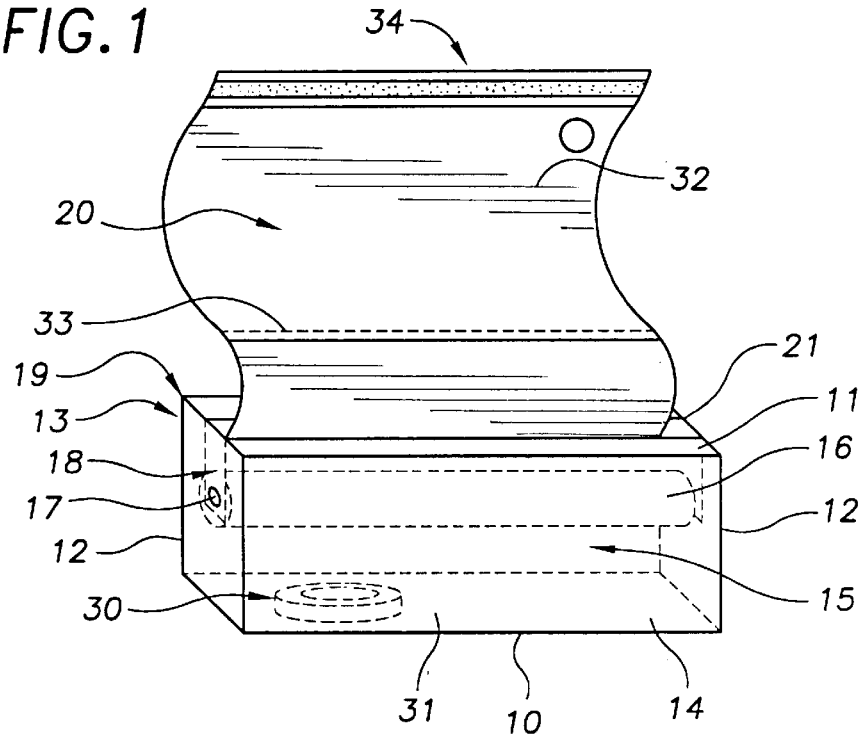
FIG. 1 is a prospective view of the feminine hygiene item disposable bag dispenser and disposable bags.

Referring to the figures in detail FIG. 1 illustrates the dispenser 10 generally as a rectangular box with a top side 11, two ends 12, a mounting backside 13, and a front 14. The dimensions of the rectangular dispensing box 10 may vary however the box is preferably approximately 6 inches to about one foot in length and about 3 to about 4 inches wide and about 3 to about 4 inches tall. The box 10 is preferably constructed of a durable material such as ABS plastic which would lend the box to be manufactured from a plastic molding technique which would also allow the dispensing box 10 to be manufactured at relatively low cost. An interior 15 of the dispensing container receives a roll of disposal bags 16. The roll of the disposal bags 16 includes a multiplicity of bags 20 while the number of bags 20 on a given roll is limited by the diameter of a full roll of bags on a spindle 17. The roll bag spindle 17 is used to hold the rolled bags in a rolled configuration and also mounts the roll on the interior 15 of the box 10. The spindles 17 is captured within the interior 15 of the dispenser 10 by opposing channel ways 18 which are positioned on an interior surface of each end of the interior 15 of the dispensing device.

The top of the dispensing device 11 is hingedly secured to a back top edge 19 of the dispensing container 10. The hinged top 11 allows the user to gain access to the interior 15 of the dispensing container for replacing the roll of disposal bags 16. When necessary to replace a roll of bags, the user simply opens the hinged top 11 and pulls the empty spindle 17 from the interior of the dispenser, and a new roll of bags is then inserted with its spindle within the channel ways 18 of the interior of the dispensing unit. The first bag on the roll is then fished through an elongated slot 21 positioned on the hinged top 11, the hinged top is then allowed to fall to its position closing the interior of the dispensing container. The elongated slot 21 is dimensioned to easily allow passage of a bag 20 from the dispenser interior 15 to the exterior of the dispensing unit allowing a user to easily grab a disposal bag 20 when desired.

The interior of the dispensing unit also includes a deodorizing means 30 which is preferably located on an interior bottom surface 31 of said dispensing unit. The deodorizing means 30 may include a chemical agent which is containerized within a replaceable deodorant container with a visual deodorant depletion indicator indicating to the user when the deodorant dispenser should be replaced. The deodorizing container 30 can also be a rechargeable deodorizing absorbent material which may be refilled with any desirable odorant the user may desire. The deodorizer 30 provides deodorant on the interior of the dispenser 15 which results in a small amount of deodorant attaching to an exterior surface of the disposal bags 32. The application of the deodorant to an exterior surface of the disposal bags 20 assures that a disposable bag 20 will not cause noxious odors once placed in a trash receptacle.

The disposable bags 20 which are contained on a roller are continuous and separated by perforations 33. The perforations 33 allow a user to easily separate bags when desired from the continuous roll 16. The bags 20 also include a top edge sealing means 34 which is a typical tongue and groove bag sealing means which is in use for food storage bags, freezer bags and the like. An interior of the bags include an antibacterial chemical agent which prohibits bacterial growth on the disposed hygiene items.

The bags also include a serial numbering means which allows a user to determine the number of bags remaining on a roll within the dispenser. The serial numbering means is preferable sequential numbering on an exterior surface of the disposable bags in a location which is visible to a user of the dispenser and the disposable bags and wherein the first disposable bag on a new roll of bags is the highest number and the last bag on a roll is zero, thereby indicating to the user the number of bags remaining in the dispenser. A user is alerted when the bag numbers reach zero to replacement of the roll of bags.

Figure 2:
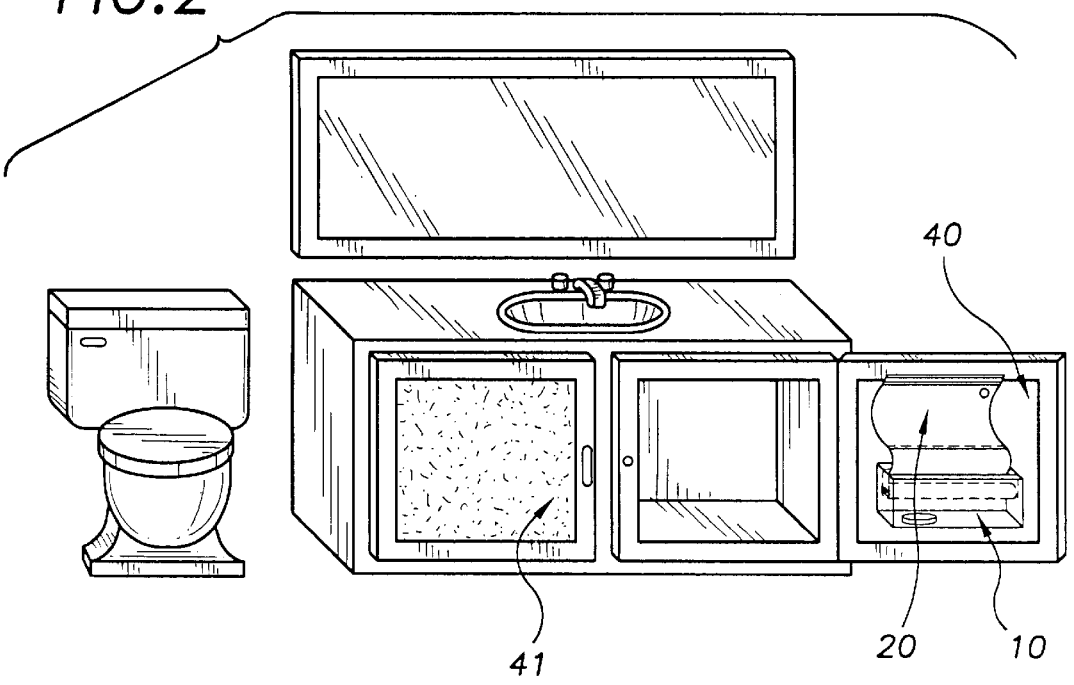
FIG. 2 is an illustration of a vanity illustrating placement of the dispensing member on an inside surface of a vanity cabinet door.

As shown in FIG. 2 the dispensing device is easily mounted on an inside surface of a vanity cabinet door 40 which provides a convenient location for gaining access to bags as needed by a user. When the vanity cabinet door is closed the dispenser is out of sight as illustrated by the closed cabinet door 41.

It is noted that the embodiment of the Disposable Bags and Dispenser for Feminine Hygiene Items described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. Disposable Bags and Dispenser for Feminine Hygiene Items comprising: a disposable bag dispenser which is dimensioned as a rectangle with an interior, a top side, two ends, a mounting backside, and a front, the interior further comprises a means for containing a roll of disposable bags rolled on a spindle, the roll of disposable bags further comprises a multiplicity of plastic bags which are continuous and separated by perforations through the plastic providing a means for separating and removing a bag from the roll of disposable bags, the spindle is mounted within the interior of the dispenser and is received by two opposing spindle channels each channel located on an interior end surface of the dispenser, the top side further comprises a hinged top which is hingedly attached to a top back edge of the dispenser and which hinged top includes an elongated slot for allowing bags to exit the interior of the dispenser when the top is in a closed position, the hinged top further providing a means for gaining access to the interior of the dispenser when the hinged top is in the open position for replacing an empty spindle with a full roll of disposable bags, a deodorizing means is located on the interior of the dispenser and is mounted to a bottom interior surface of the dispenser interior, the deodorizing means provides a means for deodorizing the interior of the dispenser and also a means for applying a small amount of deodorant to an exterior surface of the disposable bags, the disposable bags further comprise a bag top edge sealing means which comprises a tongue and groove bag flap sealing mechanism, an interior of the disposable bags comprises an antibacterial chemical agent which provides a means for preventing disposed items from becoming rancid over time, said disposable bags further comprise a serial numbering means which means is easily seen by a user of the dispenser and the disposable bags, the serial numbering means provides a means for determining the number of disposable bags remaining in the dispenser, the dispenser is mounted to a stable surface by attachment means through said mounting backside.

2. Disposable Bags and Dispenser for Feminine Hygiene Items of claim 1, wherein said disposable bag serial number means further comprises: sequential numbers printed on an exterior surface of the disposable bags wherein the first disposable bag on a new roll is a highest number and the last disposable bag on a roll is zero, thereby providing a means for indicating to a user the number of bags remaining in the dispenser.

3. The Disposable Bags and Dispenser for Feminine Hygiene Items of claim 1, wherein the dispenser interior deodorizing means further comprises: a refillable deodorant dispenser which serves as a receptacle of liquid deodorant and further serves as a dispenser of deodorizing agent.

* * * * *